US007264105B2

(12) United States Patent
Illedits

(10) Patent No.: US 7,264,105 B2
(45) Date of Patent: Sep. 4, 2007

(54) ESCALATOR WITH STEP BRUSHES, STEP OF SUCH AN ESCALATOR, AND METHOD OF MODERNIZING AN ESCALATOR

(75) Inventor: Thomas Illedits, Neufeld (AT)

(73) Assignee: Inventio AG, Hergiswil (CH)

( * ) Notice: Subject to any disclaimer, the term of this patent is extended or adjusted under 35 U.S.C. 154(b) by 0 days.

(21) Appl. No.: 11/274,606

(22) Filed: Nov. 15, 2005

(65) Prior Publication Data

US 2006/0102447 A1 May 18, 2006

(30) Foreign Application Priority Data

Nov. 18, 2004 (EP) ..... 04105889

(51) Int. Cl.
*B66B 21/00* (2006.01)

(52) U.S. Cl. ..... 198/326; 198/333

(58) Field of Classification Search ..... 198/326, 198/327, 328, 329, 330, 331, 332, 333
See application file for complete search history.

(56) References Cited

U.S. PATENT DOCUMENTS 3,986,595 A 10/1976 Asano et al.
4,519,490 A * 5/1985 White ..... 198/333
4,570,781 A * 2/1986 Kappenhagen ..... 198/333
4,858,745 A * 8/1989 Haas et al. ..... 198/333
4,984,672 A * 1/1991 Saito et al. ..... 198/333
5,082,102 A 1/1992 Reichmuth
5,242,042 A * 9/1993 Mauldin ..... 198/333
5,337,879 A * 8/1994 Fischer ..... 198/333
5,560,468 A * 10/1996 Inoue ..... 198/333
5,695,040 A * 12/1997 Watanabe et al. ..... 198/333
6,039,167 A * 3/2000 Vellinga ..... 198/333
6,131,719 A * 10/2000 Gore ..... 198/326
6,527,103 B2 * 3/2003 Neszmerak ..... 198/496
6,595,344 B1 * 7/2003 Davis et al. ..... 198/323

FOREIGN PATENT DOCUMENTS

JP 2002356294 A 12/2002
JP 2003073065 A 3/2003

* cited by examiner

*Primary Examiner*—Joe Dillon, Jr.
(74) *Attorney, Agent, or Firm*—Schweitzer Cornman Gross & Bondell LLP

(57) ABSTRACT

An escalator has steps has steps that have a step-tread surface with a step-tread edge. Step brushes are arranged on the step-tread edge perpendicularly or vertically. Step brushes may also be arranged on the edge of the step's step-riser edge. The brushes provide a barrier against the entry of objects into the gap between a moving step and the stationery skirt-panel of the escalator.

9 Claims, 2 Drawing Sheets

ESCALATOR WITH STEP BRUSHES, STEP OF SUCH AN ESCALATOR, AND METHOD OF MODERNIZING AN ESCALATOR

The present invention relates to an escalator with steps, a step of such an escalator, and a method of modernizing an escalator.

BACKGROUND OF THE INVENTION

The steps of a typical escalator are fastened to two transporting chains, together with which form an endless circulating step-band that at each end of the escalator runs over a pair of transporting-chain wheels, one of the transporting-chain wheel pairs belonging to a drive station, driving and reversing the step-band, the other transporting-chain wheel pair being part of a step-band reversing station. The individual steps of the step-band are each equipped with two front and two back guide rollers by which the steps are guided in defined location-dependent positions mainly by guiding and reversing curves fastened to the supporting construction of the escalator. The steps of the escalator run along a predetermined path that is laterally defined by stationary skirt-panels.

While it is necessary to compensate for spacing tolerances between the skirt-panel and step, a gap must remain, since a step making contact with a skirt-panel would cause considerable friction that would lead to unacceptable heating, as well as to increased drive power and wear to the step and skirt-panel. For this reason, a gap or air-gap must remain between the skirt-panel and step.

Such a gap or air-gap is a safety hazard. Because of the play present on both sides of the step, the width of a gap can become large, so that penetration by an edge of a shoe, a scarf, a high heel, a skirt-hem, or a hand, especially of a child, becomes possible. Consequently, the danger of crushing and other injuries to the passenger is not without possibility.

Injury to persons by the gap between the skirt-panel and the step step-tread area, as well as in the step step-riser area, resulting from the relative motion between the moving steps and the stationary skirt-panel, is a major problem of conventional escalators. Furthermore, if an object that is present on the moving step comes into contact with the stationary skirt-panel, the object can be pulled into the gap by friction, especially when the escalator steps are traveling upward.

Efforts have therefore been made to create a deflecting surface that will prevent penetration into the gap. Various deflectors for the gap between the step and the skirt-panel are to be found in the art.

Patent disclosure WO98/24714, for example, discloses skirt-panel brushes that are installed as deflectors on the skirt-panel but over the steps. These skirt-panel brushes divert straight objects such as, for example a leg, away from the gap between the skirt-panel and the step. In doing so, however, a foot of the leg can be so turned that the toes point in the direction of the gap and the brushes do not prevent their penetration into the gap.

U.S. Pat. No. 5,695,040 discloses slits that are installed at the side of the step in which brushes are arranged. This solution has the disadvantage that the blocking brushes are located at a certain distance below the surface of the step-tread or step-riser, respectively, with the consequence that objects can become trapped in the gap situated above them. Moreover, as the brushes are in contact with the skirt-panel, they can damage the skirt-panel, and cause noises. It has also proved disadvantageous that, through constant rubbing of the brushes against the skirt-panel, the brushes have a very short life. The forces exerted by the steps damage the structure of the brushes, which then have insufficient form stability.

It is therefore an objective of the present invention to provide an escalator, and particularly an escalator step area construction, that does not possess the aforesaid disadvantages and that substantially increases operating safety while being easy to manufacture as well as having a substantially increased service life.

BRIEF DESCRIPTION OF THE INVENTION

The foregoing and other objectives are fulfilled by the present invention in which an escalator has steps that have a step-tread surface with at least one step-tread edge. Step brushes are arranged on the step-tread edge. As used herein, the term "step-tread surface" refers to the surface of the escalator step on which passengers stand. The step-tread edge comprises the geometrical line that bounds the step-tread surface as well as the immediate vicinity of the geometrical line on the step-tread surface.

Step brushes positioned in the manner described above provide the necessary prevention of contact between objects and the skirt-panel. The step brushes both prevent contact of objects with the skirt panels and, at the same time, penetration of objects into the gap between the skirt-panel and the passing step or step-band. Furthermore, by use of step brushes, two undesired friction partners, the skirt-panel and an object in contact therewith, are brushed apart. Foreign objects, such as shoes, umbrellas, handbags, plastic bags, and other objects are brushed away from the skirt-panel by means of the step brushes, the step brushes pushing, or brushing, the objects out of the hazardous area, i.e. away from the gap between the skirt-panel and step. Consequently, the possibility of pinching or wedging of objects is greatly reduced or ruled out. Use of the escalator is thereby substantially improved and its safety substantially increased.

The brushes terminate all frictional contact between objects and the skirt-panel before penetration into the gap between the moving steps and the stationary skirt-panel can occur. Especially in the transitional radii, where there is not only relative motion between the steps and the skirt-panel but also relative motion between two adjacent steps, namely when a horizontal step-tread approaches in the upward direction a step-riser moving in front of it, any frictional contact in this critical area between step-tread and step-riser is prevented by the brushes.

The device in U.S. Pat. No. 5,695,040 does not achieve this effect, since the brushes are arranged at a distance from the step-edge. Thus, such a construction has precisely the disadvantage that friction between the object and the skirt-panel, and penetration into the gap between the skirt-panel and the step, are not prevented.

In a preferred embodiment of the invention, the step brushes are arranged along the entire step-tread edge in a direction perpendicular to the step-tread surface. The brushes are mounted or arranged with such an orientation that the brushes are generally perpendicular to the step-tread surface and project along the skirt-panel and therefore do not touch the skirt-panel. Contact with the skirt-panel only occurs when an object comes into frictional contact with the skirt-panel. All frictional contact between an object and the skirt-panel is prevented before an object can penetrate into the gap between the moving step and the stationary skirt-panel.

In a further, preferred embodiment of the invention, the steps have a step-riser surface with at least one step-riser edge on which the step brushes are arranged. The step-riser surface is the front, approximately vertical, surface of the escalator step. It is often curved, rounded, or convex. The step-riser edge is the geometrical line that bounds the step-riser surface and the immediate vicinity of this geometrical line on the step-riser surface. This embodiment further reduces the danger of penetration of an object into the air gap.

In a further preferred embodiment of the invention, the step brushes are arranged along the entire edge of the step-riser in a direction perpendicular to the step-riser surface. In this embodiment, the brushes are aligned away from the skirt-panel and do not touch the skirt-panel, with the result that no friction occurs, and the skirt-panel and the brushes have long lives.

In yet a further exemplary embodiment of the invention, the step brushes are of plastic, brass, or galvanized steel. By use of these materials, the prevention of frictional contact is further increased. Such materials also possess the advantage of more easily and/or more effortlessly and/or more unproblematically separating two objects that are in frictional contact.

In a further preferred embodiment of the invention, the step brushes are fastened onto the steps by being molded or bonded onto or into, screwed to, or snapped into the steps. Inexpensive and simple usual methods of manufacturing the brushes can therefore be used.

Advantageously, the step-tread edge may be a separate mechanical plastic component of the step, and the step brushes are fastened onto the step-tread edge by being molded around, or molded into, or bonded into it. The step brushes can therefore be made with the plastic component that forms the step-tread edge, separately from the step body itself. The complete component is then subsequently mounted on the step body in a fast and simple manner. Such a step-tread edge is easily dismountable and replaceable.

The step brushes may be arranged on a step for an escalator along the entire step-tread edge and perpendicular to the step-tread surface. Such a step can be simply and inexpensively produced semi-finished, and subsequently quickly and simply used on an escalator.

In addition to being part of a new or replacement installation, an escalator that has steps which have a step-tread surface with a step-tread edge can be modernized by the step brushes being mounted on the step-tread edge. By means of such modernization method, conventional transportation installations can also easily and quickly benefit from the advantages described above.

BRIEF DESCRIPTION OF THE DRAWINGS

Exemplary embodiments of the invention are explained in more detail in the description that follows, and are illustrated in the annexed Figures, wherein.

DETAILED DESCRIPTION OF THE INVENTION

Figure 1:
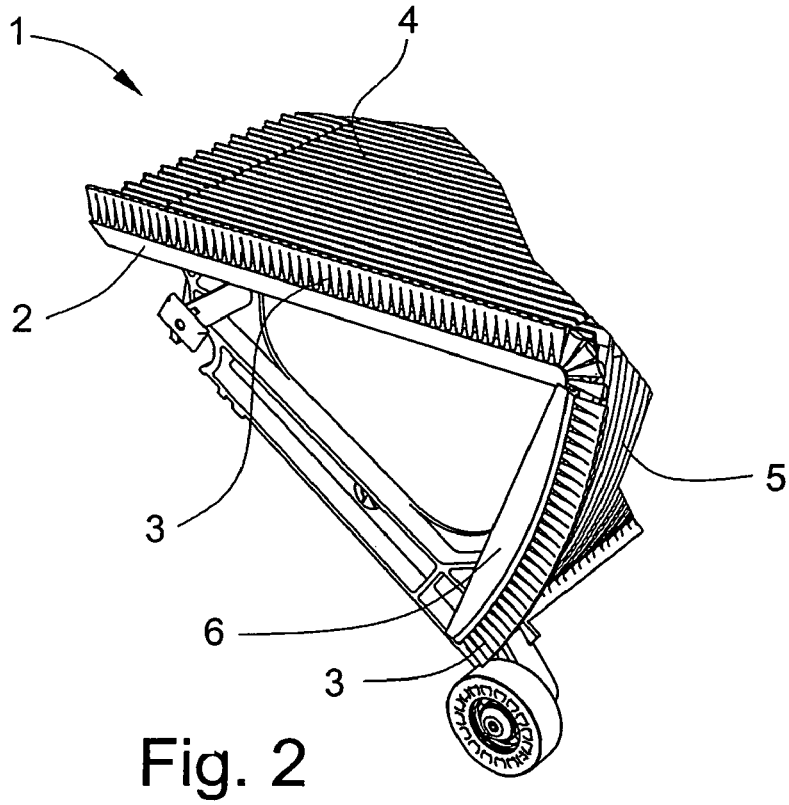
FIG. 1 is a diagrammatic representation of an arrangement of an escalator step with the step brushes according to the invention.

FIG. 1 shows in detail a step 1 for an escalator that has a step-tread surface 4 with at least one step-tread edge 2, step brushes 3 being arranged on the step-tread edge 2. When the step 1 is installed on the escalator, there is a gap, or air gap, between the step 1 and the skirt-panel of the escalator. The step brushes 3 are arranged along the entire step-tread edge 2 in a direction generally perpendicular to the step-tread surface 4, although they may be slightly inclined towards the skirt-panel. The step 1 also has a step-riser surface 5 with a step-riser edge 6 on which the step brushes 3 are likewise arranged. The step brushes 3 are arranged along the entire step-riser edge 6 in a direction generally perpendicular to the step-riser surface 5.

On an escalator with a balustrade, the step brushes 3 may be mounted on all escalator steps 1, with step brushes 3 on both the step-tread and the step-riser. The step brushes 3 are installed at both the left and right sides of the escalator step 1. The step brushes 3 deflect objects, and prevent entrapment or dragging of shoes, umbrellas, handbags, plastic bags, or other objects by the step-gap. They prevent penetration into the step-gap of foreign elements such as pieces of newspaper, plastic bags, pebbles, fibers of items of apparel, and coarser soiling matter, as well as snow and ice.

The step brushes may advantageously have a fanlike, spreading structure, which further acts as a sealing arrangement for the gap. The step-gap is closed off, and access to the side-edge of the escalator step is made impossible. A further advantage of the step brushes 3, relative to fixed edge-elements or stationary panels, is their flexibility. When laterally touched by footwear, they yield flexibly, and the space required in the particular situation is made free.

The step brushes 3 prevent access to, or penetration into, the gap between the skirt-panel and step. A dense, hermetic, impenetrable boundary of bristles left and right of the escalator step 1 is formed.

The step brushes 3 can be fastened onto the escalator step 1 by being molded onto, or bonded onto, or screwed to, or bonded into, or snapped into it.

Figure 2:
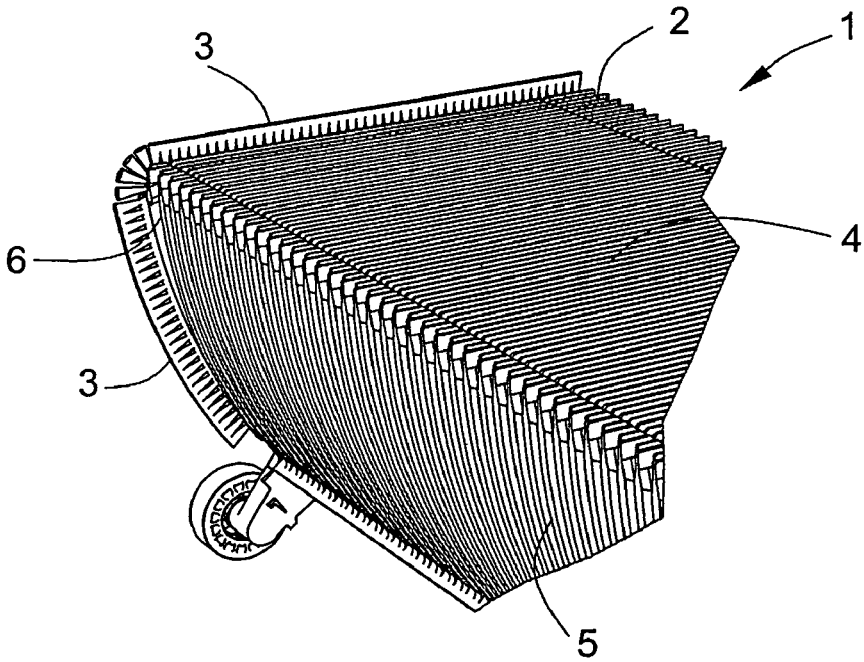
FIG. 2 is a diagrammatic representation of an arrangement of an escalator step with the step brushes according to the invention and with a separate plastic step-tread edge.

FIG. 2 shows diagrammatically an arrangement of an escalator step 1 with step brushes 3 according to the invention, and with a separate plastic step-tread edge 2. In this embodiment of the invention, the step-tread edge 2 is a separate mechanical plastic component of the step 1, and the step brushes 3 are fastened onto the step-tread edge 2 by being molded around, or molded into, or bonded into it.

Such plastic edges are preferably yellow, so as to give passengers a clearly visible indication of the presence of a gap. The danger or warning is thus made clearly visible. The step brushes 3 may be manufactured together with the yellow plastic edges 2, and mounted or screwed along with them onto the step body 1.

The step brushes 3 form a barrier, or obstacle, to passengers, and hinder or impede the touching of the skirt-panel. No access to the skirt-panel gap is possible, and pinching or wedging or crushing is impossible. The step brushes 3 thus isolate the stationary (skirt-panel) components from the moving (escalator step) components.

The sliding together of an object and the skirt-panel is completely prevented by the step brushes 3. Furthermore, the step brushes 3 are executed so solidly that they withstand the wear and tear of passenger traffic. For this reason, a durable, robust, wear-resistant brush material must be used such as, for example, plastic, brass, or galvanized steel wire bristles. Adequate dimensioning and design of the step brushes 3 can be determined by one skilled in the art in consideration of the number of passengers and the wear and tear resulting therefrom.

In a preferred embodiment of the invention, the ends of the bristles of the step brushes are rounded. This is advantageous, since the danger of injury to passengers through contact with the bristles is thereby reduced.

Figure 3:
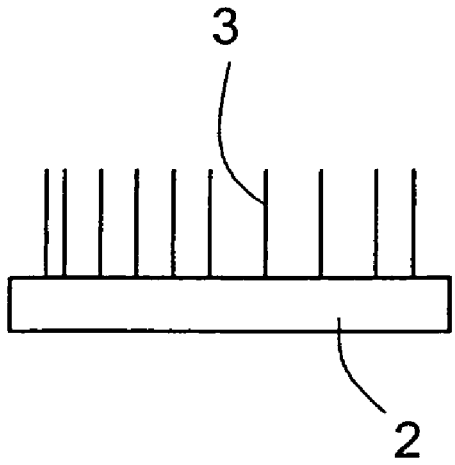
FIG. 3 is a schematicized view of a step brush with straight bristles.
Figure 4:
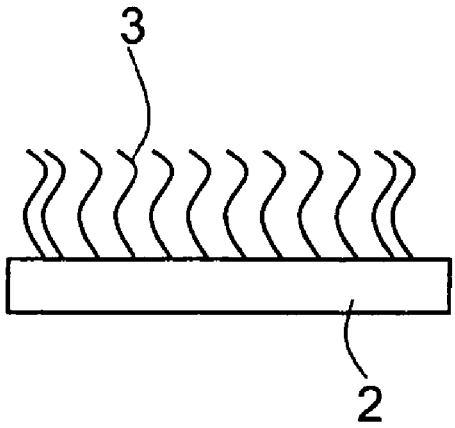
FIG. 4 is a schematicized view of a step brush with waved bristles.

In a further embodiment of the invention, the bristles of the brushes are waved. This is advantageous because such brushes have high stability of form and a longer life. FIG. 3 shows step brushes with straight bristles, while FIG. 4 shows step brushes 3 with waved bristles.

The waved structure increases the mechanical strength of the bristles and allows better distribution of the forces that are exerted by objects or passengers. In comparison with straight bristles, the waved structure stabilizes the bristles against bending out of line from their longitudinal axis. If a straight bristle is loaded along its longitudinal axis, it bends and can no longer exert an opposing force. By contrast, waved bristles absorb the load along the longitudinal axis as a spring tension that is stored in the waves. The bristles retain their alignment and are not permanently bent or deformed.

On account of their density, the waved bristles can significantly reduce the gap or air gap between the running, driven, escalator step 1 and the skirt-panel, the danger of a foot of a passenger penetrating into the gap, or air gap, being thereby further reduced.

The step brushes 3 can be factory-fastened without problem onto a step 1 for an escalator that has a step-tread surface 4 with a step-tread edge 2, along the entire step-tread edge 2 with orientation and/or alignment perpendicular to the step-tread surface. This allows fast and simple installation of the step brushes 3 on the escalator and reduces the manufacturing costs and installation costs.

An escalator with steps 1 that have a step-tread surface 4 with a step-tread edge 2 can also be modernized by the step brushes 3 being fastened onto the step-tread edge 2. This method of modernization by the attachment of step brushes 3 allows fast and simple improvement of the escalator with regard to operating safety and passenger safety, since the dangers of being trapped, being pinched, and being wedged are prevented.

I claim:

1. An escalator with steps that have a step-tread surface with at least one step-tread edge, characterized in that step brushes are arranged on at least one of the step-tread edges projecting above the step-tread surface as a barrier to the entry of objects into a gap between the step and a skirt panel, the step brushes having waved bristles.

2. The escalator according to claim 1, characterized in that the step brushes are arranged along an entirety of the step-tread edge and extend in a direction perpendicular to the step-tread surface.

3. The escalator according to claim 1 or 2, further characterized in that the steps have a step-riser surface with at least one step-riser edge on which step brushes are arranged.

4. The escalator according to claim 3, characterized in that the step brushes on the step-riser edge are arranged along an entirety of the entire step-riser edge in a direction perpendicular to the step-riser surface.

5. The escalator according to claim 1 or 2, characterized in that the step brushes comprise bristles of plastic, brass or galvanized steel.

6. The escalator according to claim 3, characterized in that the step brushes comprise bristles of plastic, brass or galvanized steel.

7. The escalator according to claim 1 or 2, characterized in that the step-tread edge is a separate mechanical plastic component of the step, and that the step brushes are fastened onto the step-tread edge.

8. The escalator according to claim 1 or 2, characterized in that the step brushes have an outwardly tapering configuration towards a distal end.

9. A step for an escalator, the step having a step-tread surface with a step-tread edge, characterized in that step brushes are arranged along an entirety of the step-tread edge projecting above the step-tread surface with an orientation and alignment perpendicular to a surface of the step-tread, the step brushes having waved bristles.

* * * * *